US006944983B1

(12) United States Patent
Rasmussen

(10) Patent No.: US 6,944,983 B1
(45) Date of Patent: Sep. 20, 2005

(54) CHANGING COLOR OBJECT

(76) Inventor: Adam Rasmussen, P.O. Box 759, Minden, NV (US) 89423

( * ) Notice: Subject to any disclaimer, the term of this patent is extended or adjusted under 35 U.S.C. 154(b) by 0 days.

(21) Appl. No.: 10/309,769

(22) Filed: Dec. 3, 2002

Related U.S. Application Data

(60) Provisional application No. 60/393,701, filed on Jul. 2, 2002.

(51) Int. Cl.[7] ..... G09F 13/00
(52) U.S. Cl. ..... 40/434
(58) Field of Search ..... 40/434, 433, 435; 359/498, 397, 489, 483

(56) References Cited

U.S. PATENT DOCUMENTS

| | | | | | |
|---|---|---|---|---|---|
| 2,018,214 | A | | 10/1935 | Land | 240/10 |
| 2,393,968 | A | | 2/1946 | Bruchell et al. | 272/10 |
| 2,473,857 | A | * | 6/1949 | Burchell | 359/489 |
| 2,506,134 | A | * | 5/1950 | Burchell | 40/548 |
| 2,506,135 | A | | 5/1950 | Burchell | 88/65 |
| 2,535,781 | A | * | 12/1950 | Burchell | 359/489 |
| 3,315,391 | A | * | 4/1967 | Lane et al. | 359/497 |
| 3,535,805 | A | * | 10/1970 | Peiperl | 40/406 |
| 3,679,888 | A | * | 7/1972 | Reiback | 40/435 |
| 3,694,054 | A | * | 9/1972 | Kirsch | 359/498 |
| 3,762,082 | A | * | 10/1973 | Mincy | 40/433 |
| 3,793,755 | A | * | 2/1974 | Gersch et al. | 40/433 |
| 3,841,730 | A | | 10/1974 | Karelitz | 350/5 |
| 3,927,461 | A | * | 12/1975 | Peiperi | 29/424 |
| 3,971,928 | A | * | 7/1976 | Kirsch et al. | 362/253 |
| 4,742,439 | A | | 5/1988 | Choate | 362/311 |
| 4,798,448 | A | | 1/1989 | van Raalte | 350/345 |
| 5,748,376 | A | | 5/1998 | Lin et al. | 359/629 |
| 6,044,196 | A | | 3/2000 | Winston et al. | 385/146 |
| 6,335,999 | B1 | | 1/2002 | Winston et al. | 385/146 |
| 6,362,920 | B1 | | 3/2002 | Hannah | 359/497 |

FOREIGN PATENT DOCUMENTS

| | | | |
|---|---|---|---|
| WO | WO 88/05549 | 7/1988 | G02B 5/20 |

* cited by examiner

*Primary Examiner*—Mark T. Le
(74) *Attorney, Agent, or Firm*—Sierra Patent Group, Ltd.

(57) ABSTRACT

A device displaying a polychromatic effect, comprising a light source a first linear polarizing layer optically coupled to said light source a first bi-refringent layer a second linear polarizing layer a motor coupled to said first linear polarizing layer so that said first linear polarizing layer rotates, varying the polarizing angle between said first linear polarizing layer and said bi-refringent layer.

10 Claims, 10 Drawing Sheets

CHANGING COLOR OBJECT

CROSS REFERENCE TO RELATED APPLICATIONS

This application is a Utility application which claims priority to an earlier filed U.S. Provisional application No. 60/393,701, filed Jul. 2, 2002.

FIELD OF THE INVENTION

The invention disclosed in this document relates to an object and base, wherein the object appears to have a polychromatic effect.

BACKGROUND

Light is a complex phenomenon that may be explained with a simple model based on rays and wave-fronts.

Visible light represents only a small portion of the entire electromagnetic spectrum of radiation that extends from high-frequency gamma rays through X-rays, ultraviolet light, infrared radiation and microwaves to very low frequency long-wavelength radio waves.

Very high-frequency electromagnetic radiation such a gamma rays, X-rays, and ultraviolet light possess very short wavelengths and a great deal of energy. On the other hand, lower frequency radiation such as visible, infrared, microwave, and radio waves have correspondingly greater wavelengths with lower frequencies and energy. The vast majority of the light we see is emitted from the sun, which also emits many other frequencies of radiation that do not fall in the visible range. When indoors, we are exposed to visible light that comes from "artificial" sources primarily originating from fluorescent and/or tungsten devices.

Reflection of light and other forms of electromagnetic radiation occur when waves encounter a boundary that does not absorb the radiation's energy and bounces the waves off the surface. The incoming light wave is referred to as an incident wave and the wave that is bounced from the surface is called the reflected wave.

The refraction of visible light is an important characteristic of lenses that allows them to focus a beam of light onto a single point. Refraction, or bending of the light, occurs as light passes from a one medium to another when there is a difference in the index of refraction between the two materials.

Diffraction of light occurs when a light wave passes by a corner or through an opening or slit that is physically the approximate size of, or even smaller than, that light wave's wavelength. Diffraction describes a specialized case of light scattering in which an object with regularly repeating features, such as a diffraction grating, produces an orderly diffraction of light in a diffraction pattern. In the real world most objects are very complex in shape and should be considered to be composed of many individual diffraction features that can collectively produce a random scattering of light.

Natural sunlight and most forms of artificial illumination transmit light waves whose electric field vectors vibrate in all perpendicular planes with respect to the direction of propagation. When the electric field vectors are restricted to a single plane by filtration then the light is said to be polarized with respect to the direction of propagation and all waves vibrate in the same plane.

An important characteristic of light waves is their ability, under certain circumstances, to interfere with one another.

One of the best examples of interference is demonstrated by the light reflected from a film of oil floating on water or a soap bubble, which reflects a variety of beautiful colors when illuminated by natural or artificial light sources.

Anisotropic crystals have crystallographically distinct axes and interact with light in a manner that is dependent upon the orientation of the crystalline lattice with respect to the incident light. When light enters a non-equivalent axis in an anisotropic crystal, it is refracted into two rays each polarized with the vibration directions oriented at right angles to one another, and traveling at different velocities. This phenomenon is termed "double-" or "bi-refraction" or "bi-refringence" and is seen to a greater or lesser degree in all anisotropic crystals.

This phenomenon can be duplicated using other means such as photoelasticity and stress Refringence. Photoelasticity is the property of some materials (including most plastics) that compression can cause birefringence. The effect is also known as mechanical birefringence or stress refringence. Stress Refringence is the phenomenon that occurs when certain transparent or translucent materials are subjected to external or internal stresses. The existing stress, which usually varies from point to point, causes local changes in the index of refraction. This in turn means variations in the speed of light through the material. When coming from a beam of polarized light, individual rays take different paths through the material and, upon recombining, produce interference patterns. Properly interpreted, lines of the same refringence indicate points in the material of the same stress. This is the principle that underlies the technique of photoelasticity.

Further, bi-refringence may be created using Oriented polymer films. The oriented polymer film has polymer chains oriented along an axis, effectively creating a crystal structure as described in the definitions above. By applying numerous layers of varied thickness and orientation, you can further modify the local index of refraction and corresponding patterns of birefringence.

Another means of creating the phenomenon is Stressed Transparent objects. Stressed Transparent objects are created by varying the stress in a transparent object (be it of acrylic, glass, or any transparent object) color may be created (as described above) through the variation of the stress patterns. The patterns are created from the photoelastic effect or stress refringence.

The concept of color temperature is based on the relationship between the temperature and radiation emitted by a theoretical standardized material termed a black body radiator cooled down to a state in which all molecular motion has ceased. This model is useful in relating the emission spectrum of natural and artificial light sources to the emulsion characteristics of individual photographic films and electronic digital cameras.

Visible light contains primary colors that are fundamental to human color vision. The primary additive colors are red, green, and blue, while the primary subtractive colors are cyan, magenta, and yellow. Adding the primary additive colors together in equal portions yields white, and adding the primary subtractive colors together (also in equal portions) yields black.

Most natural and artificial light sources emit a broad range of wavelengths that cover the entire visible light spectrum. However, it is often desirable to produce light that has a restricted wavelength spectrum. This can be easily accomplished through the use of specialized filters that transmit some wavelengths and selectively absorb or reflect unwanted wavelengths.

Glass lenses are composed of glass or transparent plastic, which allow light to be focused, magnified, and/or scattered to produce a wide spectrum of effects. Most lenses have two surfaces that are ground and polished in a specific manner designed to produce either a convergence or divergence of light passing through the lens.

DETAILED DESCRIPTION

Most light sources produce light that is un-polarized or that is vibrating in all directions. A linear polarizer filters this random light by allowing only light waves vibrating in one plane to pass through it.

Light travels through different materials at different speeds (this is the index of refraction). Certain materials have a property that causes light to travel through it at two different speeds (bi-refringent). Polarized light traveling through the bi-refringent material will be resolved into two perpendicular components and since the light is traveling at different speeds in the two directions, the two components become out of phase with each other.

When this light now passes through a second linear polarizer (the first linear polarizer produced the polarized light in the first place), the components of the 2 waves that are vibrating in the same plane will pass through the polarizer and since they are still out of phase, interference will occur and color will result. The colors that are seen are dependent on the viewing angle and the orientation of the polarizers' optical axis with respect to each other. The thickness and type of bi-refringent material also play a part in the colors that are seen.

Thus, the disclosed system comprises a light source that transmits light through three different layers: 1) a first linear polarizing layer; 2) a bi-refringent layer; and 3) a second linear polarizing layer. Further any one or more of the layers may be rotated. The rotation of at least one of the layers will produce a polychromatic effect, whereby a viewer may see many different colors changing into other colors. By coating an object (internally or externally), such as a statuette or figurine with the second polarizing layer (or with the second polarizing layer and a bi-refringent layer under it) you may produce the effect of producing changing color in that object, so long as at least one of the layers is being rotated. This effect can be expanded to transparent liquids in that if you were to place a liquid over the second polarizing film you would also see a color change through that liquid.

Figure 1:
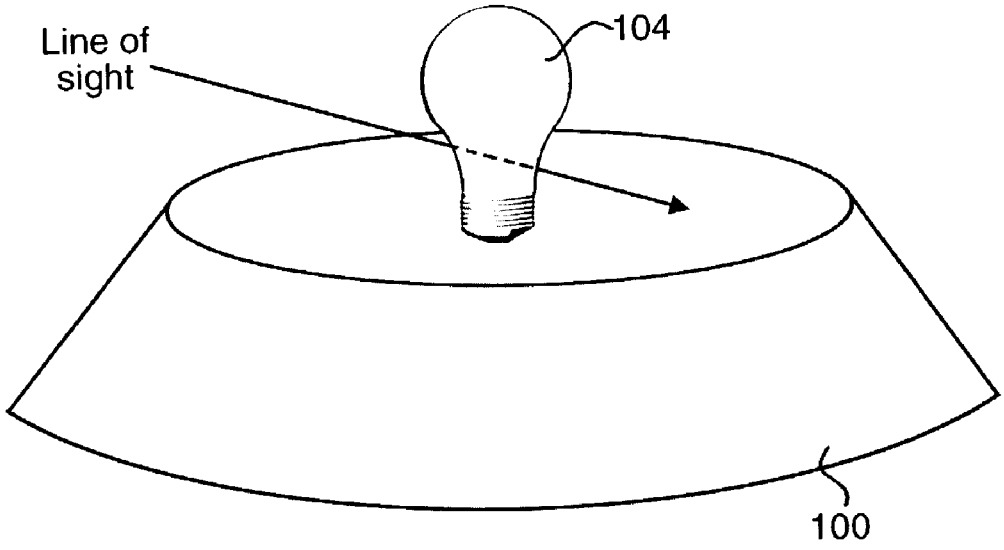
FIG. 1 illustrates a first exemplary embodiment in accordance with this invention.

Referring to FIG. 1, one embodiment of the disclosed system is shown. The disclosed device consists of two main parts, a housing 100 and an object 104. The object 104 may be a statue, figurine, or any ornamental object that is transparent or translucent. The housing 100 is shown in more detail in FIG. 2.

Figure 2:
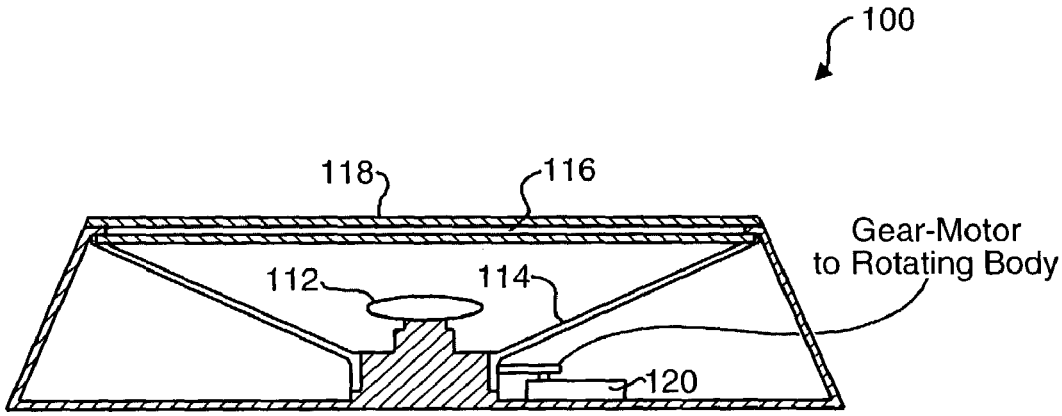
FIG. 2 illustrates a cross section of the first exemplary embodiment in accordance with this invention.

Referring to FIG. 2, the housing comprises a fixed light source 112, which is positioned within a rotating body 114. The light source may comprise different types of light sources such as diffuse light or white light. The light source and power for the rotating body can be anything from a motor 120 and light bulb 112 to a candle and rotating mast powered by convection. The top of the rotating body may have a linearly polarized element 116 such that the polarized element rotates with the body. The housing itself contains this light source and rotating body and on the top of the housing is another element 118. This element is fixed to the housing instead of to the rotating body, thus the element does not rotate. The element 118 has a bi-refringent property. This bi-refringent property may be comprised of a variety of bi-refringent layers in different orientations.

In another embodiment, the bi-refringent coating may be placed on the transparent or translucent sculpture described below as a preliminary coating done prior to the polarizing coating.

The object 104 from FIG. 1 may be coated with a linearly polarizing film. This sculpture is then placed on the top of the housing as shown in FIG. 1. The bi-refringent coating can also be placed on the transparent or translucent object as a preliminary coating done prior to the polarizing coating.

There is color generated in the transparent or translucent sculpture due to the fact that the viewer is looking through a 1st polarizing layer on the object, then through a bi-refringent layer on the base, then through a rotating polarizing layer, and finally to the light source. This embodiment illustrates where the various coatings may be applied, but it should be understood that the coatings can be applied in a variety of ways and in a number of combinations, and as long as one or more of the layers are rotating, the polychromatic effect will appear. The key here is that all of the coatings align such that the viewer has them all in their line of sight (in order to see the colors) and this can be done by applying the coatings in numerous combinations and orientations.

In another embodiment of the disclosed system, the base may have a concave surface for the object to be positioned on, which would allow for a greater opportunity for the changing color effect to be seen at different relative positions to the object/base system.

Figure 3:
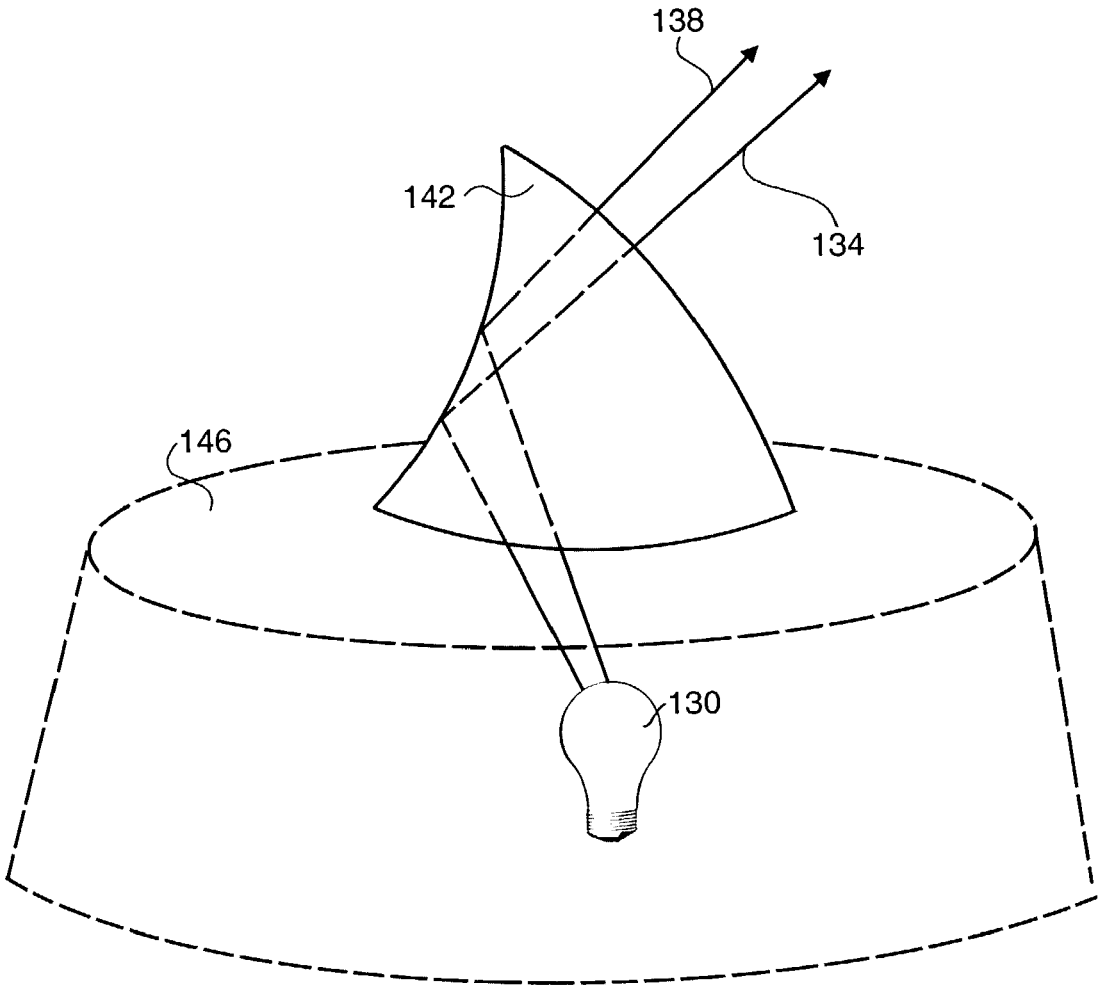
FIG. 3 illustrates a second exemplary embodiment in accordance with this invention.

Another embodiment of the disclosed system is shown in FIG. 3. A light source 130 is shown. Two rays of light 134 and 138 are shown emanating from the light source 130. An object 142 is shown. A base 146 is shown in dotted lines. The base may be essentially the same as the base described in FIG. 2. The object 142 may be coated in a second linear polarizing layer. However, the object 142 may have the property of reflecting and/or bending the light rays entering into it from the light source 130. Thus, a viewer can see light rays as they pass through the first linear polarizing layer, a bi-refringent layer of the base 146 and a second polarizing layer on the object, without necessarily having to establish a straight line of sight through the three layers, as one would have to do with the disclosed system in FIG. 1. Reflecting/ refracting of light can also be used to modify the configuration of the housing 100, whereby the light entering or exiting each of the layers can be directed to the next layer by reflection/refraction. For example, this would allow configurations that result in the light exiting the housing at an angle that is not normal to the platform (e.g., reflect the light so that it exits through a tube behind the object).

Figure 4:
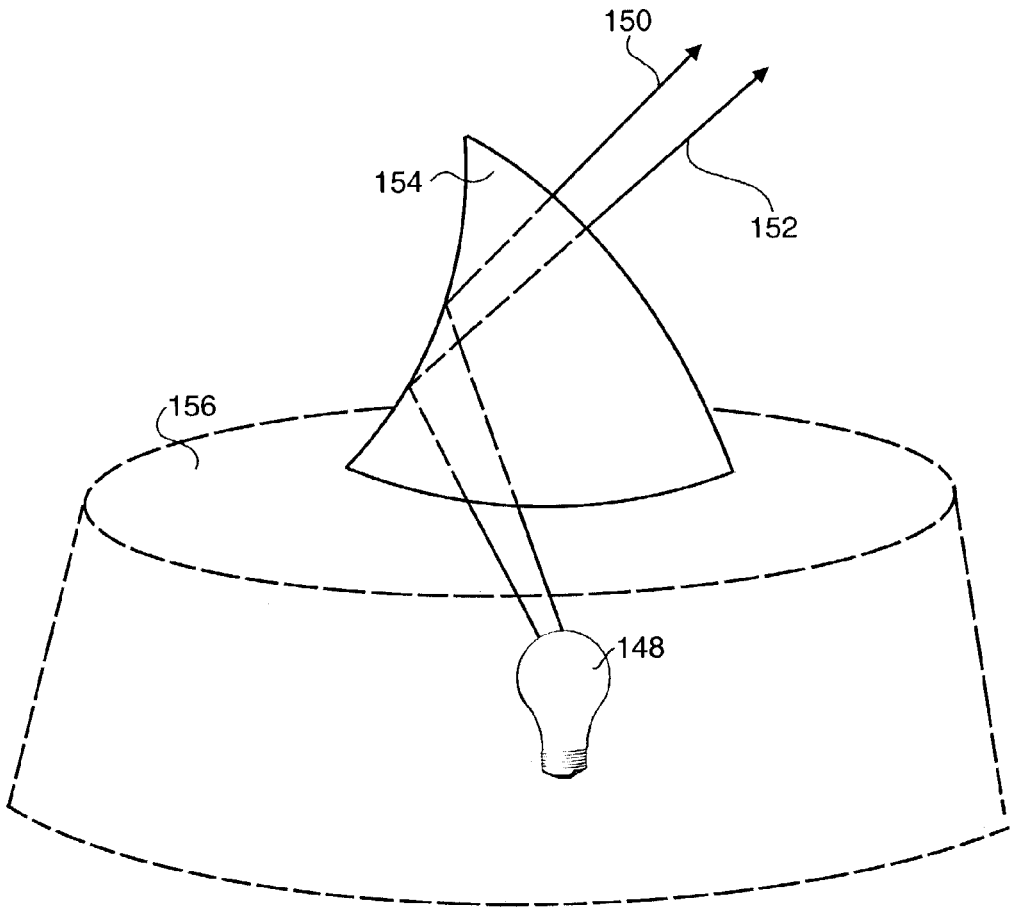
FIG. 4 illustrates a third exemplary embodiment in accordance with the present invention.

A further embodiment of the disclosed system is shown in FIG. 4. A light source 148 is shown. Two rays of light 150 and 152 are shown emanating from the light source 148. An object 154 is shown. A base 156 is shown in dotted lines. The base may be essentially the same as the base described in FIG. 2. However, the object 154 may have the property of reflecting and/or bending the light rays entering into it from the light source 148. Thus, a viewer can see light rays as they pass through the first linear polarizing layer, a first bi-refringent layer of the base and a second polarizing layer on the object 154, without necessarily having to establish a straight line of sight through the three layers, as one would have to do with the disclosed system in FIG. 1.

Figure 5:
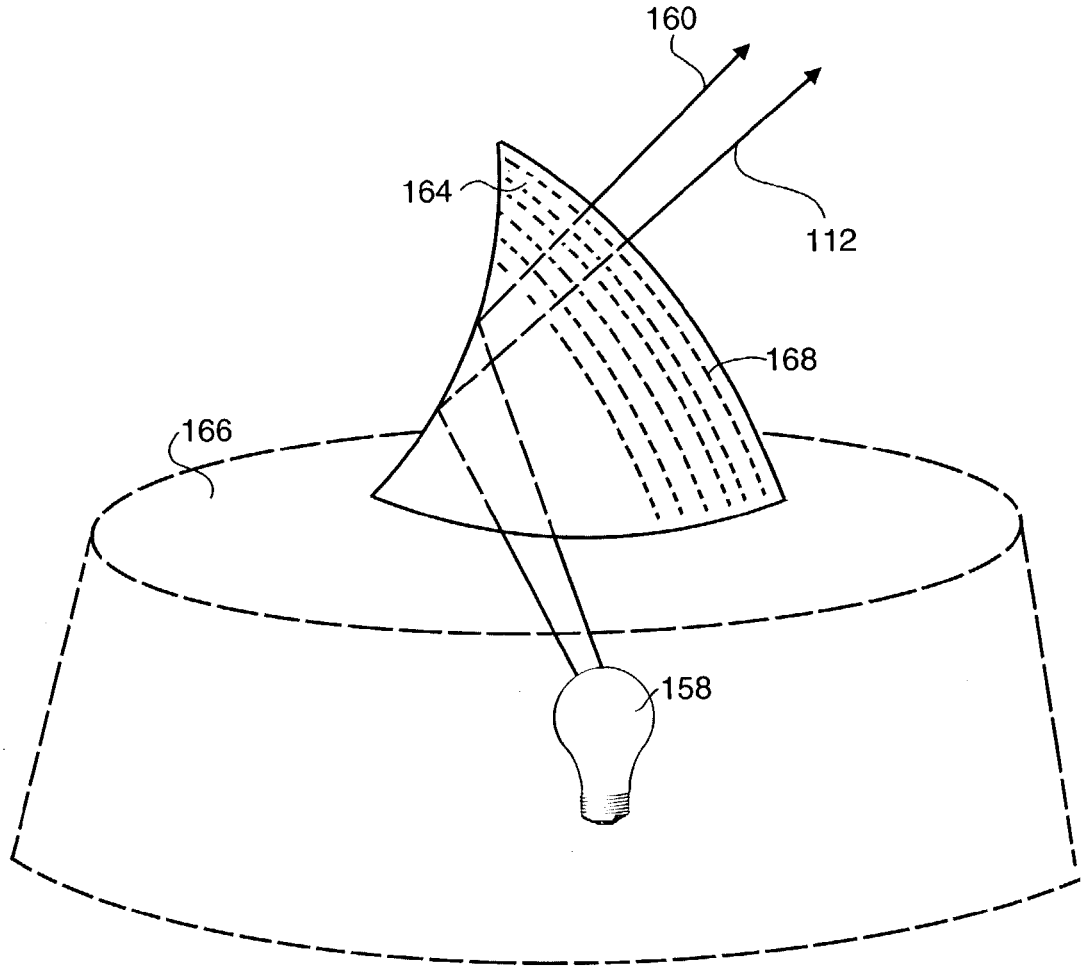
FIG. 5 illustrates a fourth exemplary embodiment in accordance with this invention.

A further embodiment of the disclosed system is shown in FIG. 5. A light source 158 is shown. Two rays of light 160 and 162 are shown emanating from the light source 158. An object 164 is shown. A base 166 is shown in dotted lines. The base 166 may be essentially the same as the base described in FIG. 2. The object 164 may be stressed to create a variety of different stress patterns within the object 164. However, the object 164 may also have the property of reflecting and/or bending the light rays entering into it from the light source 158. Thus, a viewer can see light rays as they pass through the first linear polarizing layer, a bi-refringent layer of the base 166, a second bi-refringent layer 168 created by the stresses within the object, and a second polarizing layer on the object 164, without necessarily having to establish a straight line of sight through the three layers, as one would have to do with the disclosed system in FIG. 1.

Figure 6:
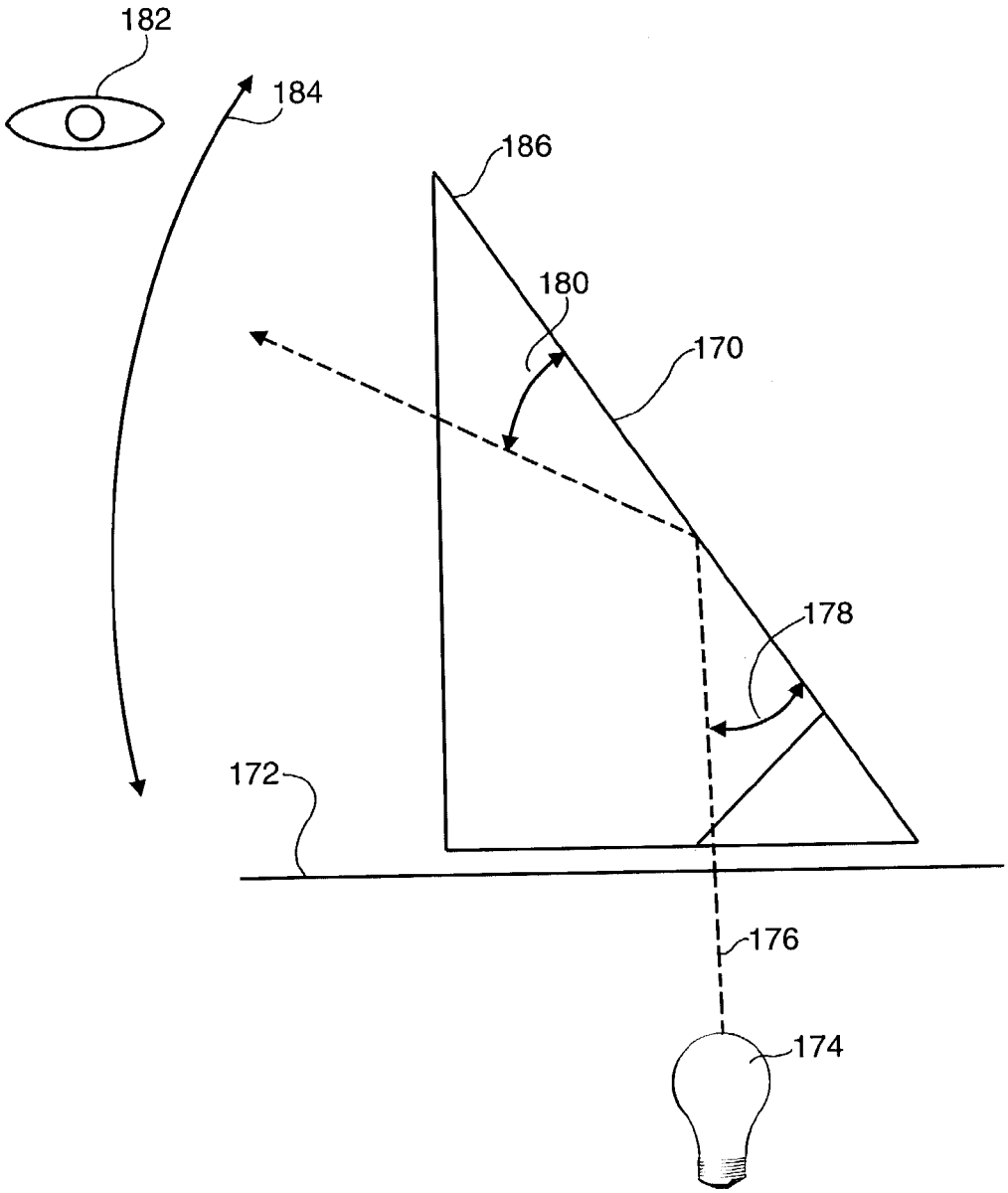
FIG. 6 illustrates a side view of an object used with any exemplary embodiment in accordance with this invention.

FIG. 6 is a side view of one of the many potential objects that may be used in the device. The object 170 is placed on a base 172, which may be essentially the same as the base described in FIG. 2. A light source 174 is shown. A single ray 176 is shown emanating from the light source 174. The ray 176 is shown with an incident angle 178 and a reflected angle 180 which are equal. The incident angle 178 and the reflected angle 180 vary with the position of the viewer 182. By adding a variety of facets to object 170 the field of view 184 may be increased so that a viewer 182 may see the color changes from many different positions. Further, the back slope 186 of the object 170 may be modified so that the reflected angle 180 provides a maximum field of view.

Figure 7:
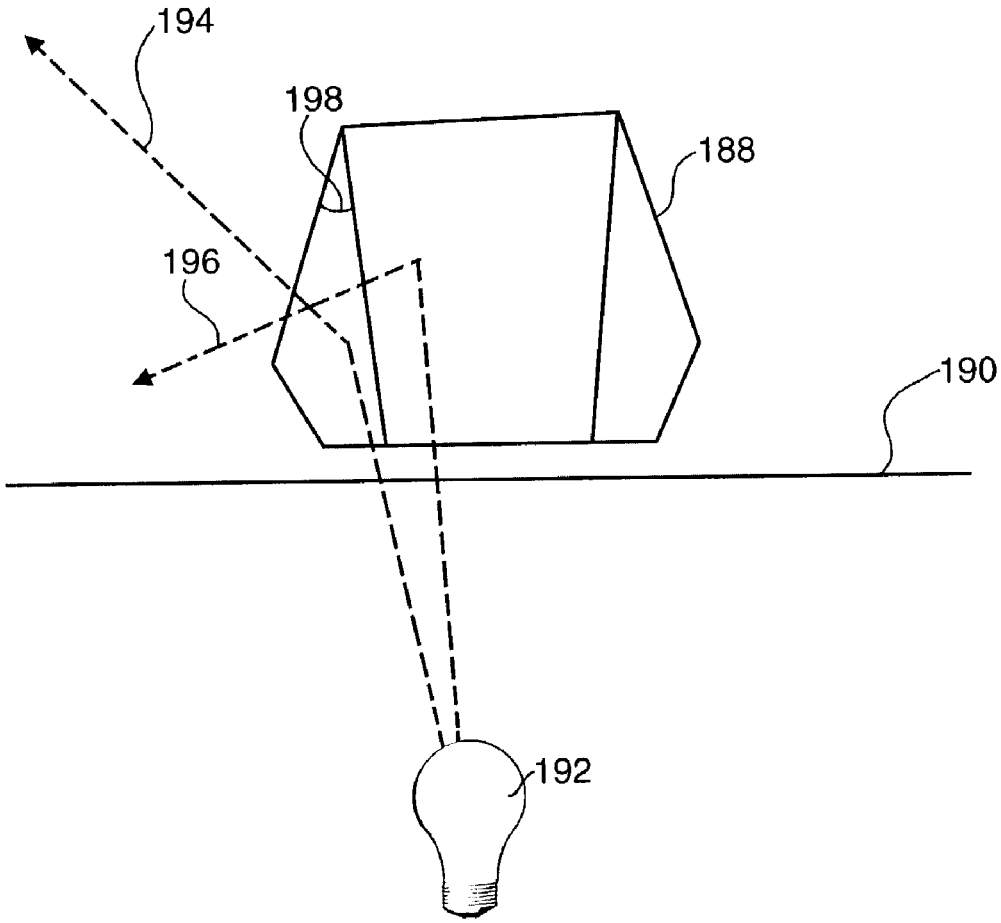
FIG. 7 illustrates a front view of the object used with any exemplary embodiment in accordance with this invention.

FIG. 7 is a front view of one of the many potential objects that may be used in the device. The object 188 is placed on a base 190, which may be essentially the same as the base described in FIG. 2. A light source 192 is shown. A pair of rays 194 and 196 is shown emanating from the light source 192. The ray 194 is shown reflecting off one of the many potential facets of the object 188. Ray 196 is shown reflecting off one of the back slope of the object 188.

Figure 8:
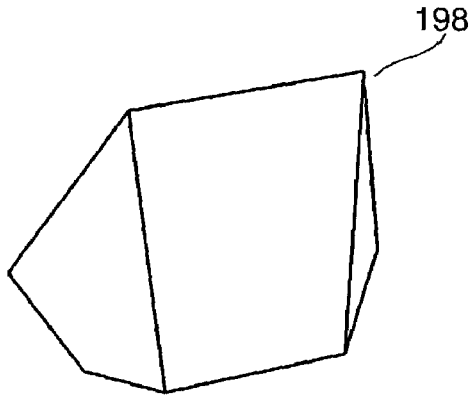
FIG. 8 illustrates an orthogonal view of the object used with any exemplary embodiment in accordance with this invention.

FIG. 8 is an orthogonal view of the object. This view is shown to further display the potential variants of the object 198. The object 188 is placed on a base 190, which may be essentially the same as the base described in FIG. 2. A light source 192 is shown. A pair of rays 194 and 196 is shown emanating from the light source 192. The ray 194 is shown reflecting off one of the many potential facets of the object 188.

Figure 9:
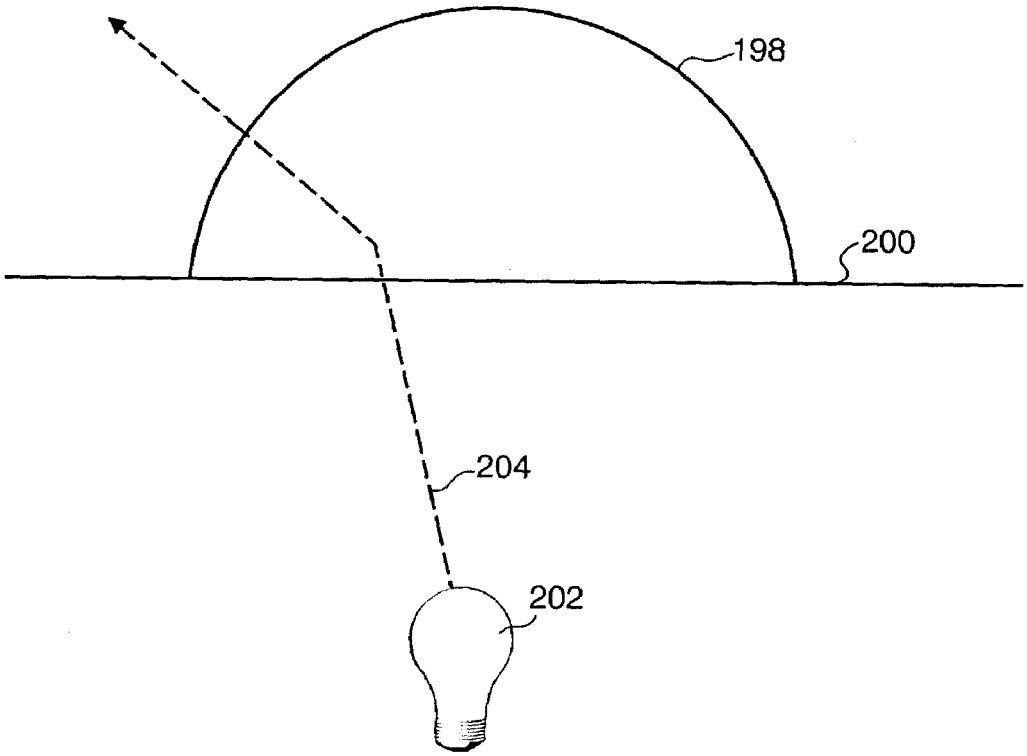

FIG. 9 is a non-angular object that uses the properties of refraction to create a field of view rather than reflection or the combination of reflection and refraction. This view is shown to further display the potential variants of the object 198. The object 198 is placed on a base 200, which may be essentially the same as the base described in FIG. 2. A light source 202 is shown. A single ray 204 is shown emanating from the light source 202. The ray 204 is shown refracting through the object 198. As seen from this embodiment the shape of the object is a non-liming factor in the present invention.

Figure 10:
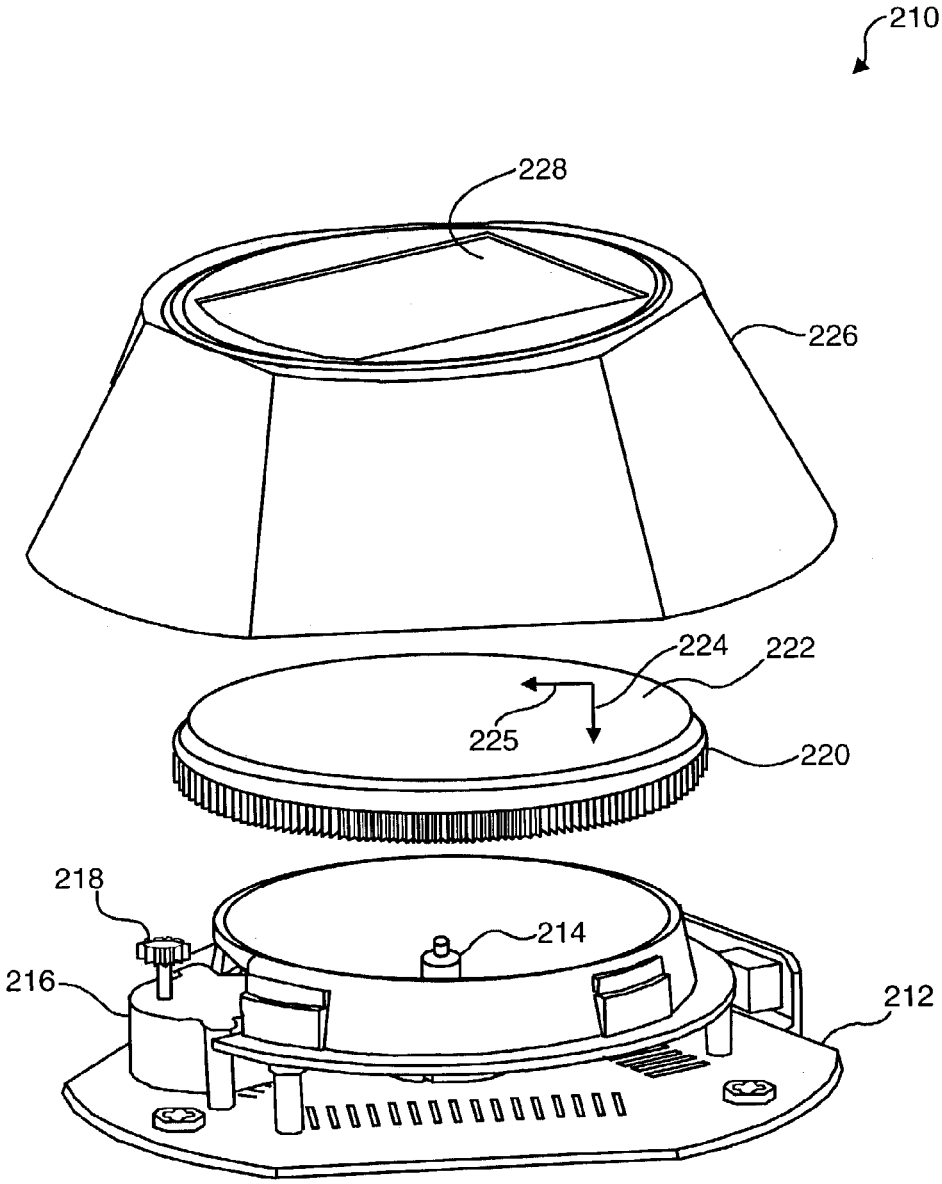
FIG. 10 illustrates an exploded view of a base of the fifth exemplary embodiment in accordance with this invention.

FIG. 10 is an exploded view of the present invention 210. The present invention includes a base 212. The base incorporates light source 214. The base 212 also incorporates a motor 216 which turns gear 218. Gear 218 turns gear 220 which is attached to a linearly polarizing film 222 which polarizes the light from light source 214 into two components 224, 225. The base 212 and the gear 220 are then covered with housing 226. Housing 226 also incorporates a bi-refringent layer 228.

Figure 11:
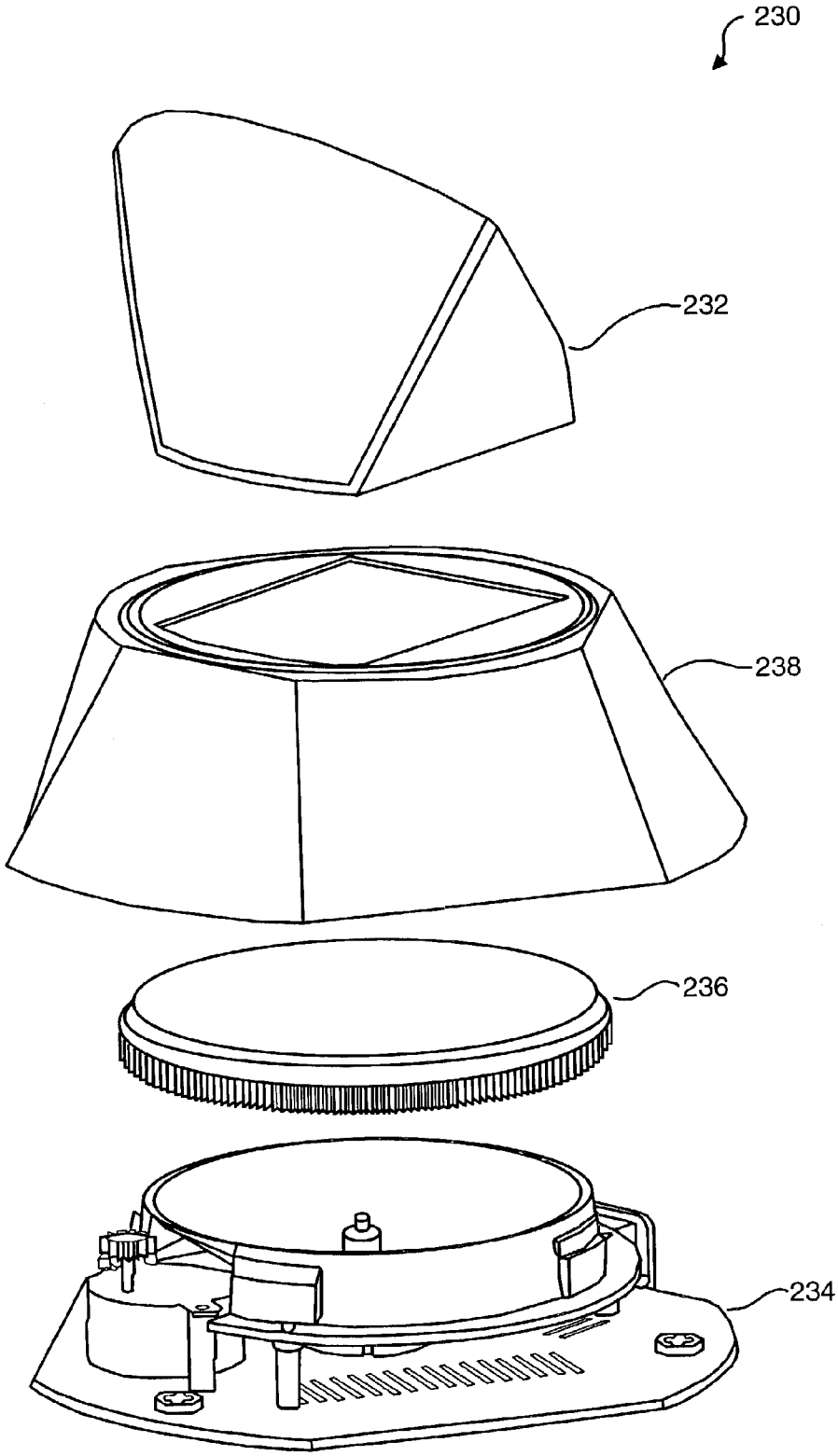
FIG. 11 illustrates an exploded view of the base and attachment of the fifth exemplary embodiment in accordance with this invention.

FIG. 11 is an exploded view of the present invention 230 incorporating object 232. Present invention 230 incorporates the base 234 and gear 236 and housing 238 as in FIG. 10. FIG. 11 further incorporates object 232 which may incorporate the bi-refringent properties discussed above and the second linear polarizing layer.

The preceding embodiments are by no means the only configurations possible. It is the intent of this disclosure to demonstrate the elements for producing the polychromatic effects in said objects. The actual orientation and configuration of a system used to produce the effects may vary from those disclosed.

What is claimed is:

1. A device for producing a polychromatic effect, comprising:

a housing having a top and a bottom defining an interior, said top including an inner and outer surface, and an optical exit port formed therein;

a light source disposed within said interior and configured to provide light along an optical pathway normal to said top and through said optical exit port;

a first birefringent layer disposed about said optical pathway;

a first linear polarizing layer disposed within said interior about said optical pathway between said light source and said first birefringent layer;

an object disposed on said outer surface about said optical pathway and configured to receive said light through said optical pathway;

a second linear polarizing layer disposed about said optical pathway between said first birefringent layer and an object;

a motor disposed within said interior and configured to rotate at least one of said first polarizing layer, said first birefringent layer, and said second linear polarizing layer; and wherein said object has predetermined optical properties being chosen so as to scatter said light at angles not normal with said top.

2. The device of claim 1, wherein said second linear polarizing layer is disposed on said object.

3. The device of claim 1, wherein said first birefringent layer is disposed within said interior.

4. The device of claim 1, wherein said first birefringent layer is disposed on said object.

5. The device of claim 1, wherein a second birefringent layer is disposed on said object.

6. The device of claim 5, wherein said second birefringent layer is created by stressing said object.

7. The device of claim 5, wherein said second birefringent layer is caused by the stress refringence of said object.

8. The device of claim 1, wherein said light source is diffused light.

9. The device of claim 1, wherein said light source is white light.

10. The device of claim 1, wherein said object is disposed on a concave surface.

* * * * *